United States Patent [19]

Wessling et al.

[11] Patent Number: 4,806,212

[45] Date of Patent: Feb. 21, 1989

[54] ELECTRODE AND THE USE THEREOF

[76] Inventors: Bernhard Wessling, Schlossstr. 17, D-2071 Tremsbüttel; Christian Funder, Kurt-Fischer-Str. 4a, D-2070 Ahrensburg; Harald Volk, Jersbeker Str. 51a; Olaf Siemers, Lohe 1b, both of D-2072 Bargteheide; Holger Merkle, Timm-Kröger-Weg 2, D-2070 Ahrensburg; Manfred Hilleberg, Hauptstr. 1, D-8097 Zaisering, all of Fed. Rep. of Germany

[21] Appl. No.: 31,849

[22] Filed: Mar. 27, 1987

[30] Foreign Application Priority Data

Mar. 27, 1986 [DE] Fed. Rep. of Germany ..... 3610388

[51] Int. Cl.[4] ..... C25F 5/00

[52] U.S. Cl. ..... 204/130; 204/147; 204/196; 204/294

[58] Field of Search ..... 204/294, 296, 196, 147, 204/130, 291

[56] References Cited

U.S. PATENT DOCUMENTS

| | | | |
|---|---|---|---|
| 4,254,727 | 5/1971 | Beckley | 204/242 |
| 4,287,032 | 9/1981 | Pellegri | 204/294 |
| 4,459,197 | 7/1984 | Solomon | 204/294 |
| 4,534,889 | 8/1985 | Van Konynenburg | 524/495 |
| 4,699,804 | 10/1987 | Miyata et al. | 427/108 |

*Primary Examiner*—John F. Niebling
*Assistant Examiner*—Kathryn Gorgos
*Attorney, Agent, or Firm*—Cushman, Darby & Cushman

[57] ABSTRACT

An electrode based on conductive material and macromolecular materials as the binder, which is stable under electrolysis conditions and is particularly suitable for drying masonry, comprising (A) a thermoplastic polar polymer, polycondensate or polyadduct or a mixture thereof, which is wettable by an electrolysis medium and is stable with respect to an electrochemical process taking place on the electrode, and (B) a mixture in a weight ratio of 1:4 to 4:1 of (a) conductive carbon black with a BET-surface of more than 600 $m^2/g$ and/or an intrinsically conductive polymer and (b) carbon black with a BET-surface of less than 600 $m^2/g$ and/or graphite and/or transition metal oxides and/or an intrinsically conductive polymer.

13 Claims, No Drawings

ELECTRODE AND THE USE THEREOF

The invention relates to electrodes based on thermoplastic macromolecular materials and conductive nonmetallic additives, as well as the use thereof.

Electrodes are used for various electrochemical purposes, particularly in aqueous media, e.g. for the electrochemical synthesis of materials, for electrolysis, for measuring purposes or as sensors, as well as in voltaic or primary cells for storing electrical energy.

When metals are not used as the electrode material, generally graphite electrodes are used. Consideration has been given of late to the use of intrinsically conductive polymers in complexed (doped), pure form, e.g. electrodes of polyacetylene, polypyrrol, polyaniline, polyphenylenes, polyphenylene sulphides, polyphtalocyanines, polythiophenes and also polymers with conjugated $\pi$ electron systems, which have however hitherto only been used as electrodes in rechargeable batteries (cf. A. J. Heeger, A. G. McDiarmid et al, Phys. Rev. Lett. 39, 1089 (1977); P. J. Nigrey, et al., J. Elektrochem. Soc. 128, 1651 (1981)).

Electrodes are known which can be produced by thermoplastic processing processes (e.g., extrusion or injection molding) from mixtures of thermoplastic macromolecular materials with conductive nonmetallic additives and are stable under electrolysis conditions (cf. e.g. D. Kyriacon and D. Jannakondakis, "Electrocatalysis for Organic Synthesis", New York, 1986). A particularly interesting use for such electrodes under complex electrolytic conditions are electrical processes for removing capillary dampness in masonry or brickword. Capillary dampness and the salting of brickwork, as well as the corrosion of reinforced concrete is a serious socioeconomic and preservation problem. The renovation of buildings is highly complicated and obviously the problem has still not been solved, despite what is claimed by various manufacturers and marketing companies of different mechanical, chemical and electrokinetic process (cf. e.g. C Ahrendt, "Trockenlegung", Stuttgart, 1983). Independently of the nature of the process, numerous failures must be set against the small number of successes.

The use of electric power for drying masonry is frequently described in the general and the patent literature (cf. e.g. C. Ahrendt, loc. cit.) and is generally called an electroosmotic, electrokinetic or electrophysical process.

Clearly the fundamental problems of the electrocal drying of brickwork have not been recognized:

1. A part from model systems, as a result of the salt content of the brickwork, drying effects can only be observed above the decomposition voltage of water.
2. The electrochemical processes which occur lead to the formation of $H_2$ at the cathode and mainly $Cl_2$ (and not as often claimed $O_2$) at the anode and which is immediately converted into $OCl^-$ (hypochlorite). Therefore the anode is exposed to electrolytic, oxidative and as a result of ion transfer also mechanical decomposition processes.
3. Electrodes and in particular carbon black-filled plastic electrodes, built up a counter-potential of 0.5 to 2 mV and above, which acts against the potential applied and greatly reduces the current flow. As a result of this potential, there would also appear to be a serious drop in the efficiency of the electrodes.

If precious metals cannot be used for obvious cost reasons, the metal or plastic electrodes used are exposed to these processes. The overall result with all these electrodes is that the current rapidly drops, the electrodes decompose or build up a very high resistance. The processes described in the patent literature have failed to take account of these problems. In exemplified manner reference is made to a few processes and their problems: P.Friese et al DE-OS 34 30 449 (electrolytically decomposing metal electrode); C. Meisel-Crone. DE-AS 14 59 998 (compacted graphite electrode: very unstable); H. Oppitz, EP-OS 100 845 and AT-OS 3101/82 (network-like, conductively coated carbon fiber electrode: network rapidly loses electrode contact with electrode, which is soon decomposed); M. W. Tenge, DE-OS 27 06 172, as well as 27 06 193, 2705 814, 2705 813 and 25 03 670 (carbon black-filled PTFE electrodes; with $\leqq 2V$ the operating voltage is too low, poor contact with the brickwork and very low conductivity).

However, apparently electrical brickwork drying is linked with electrolysis and the renovation effects observed are put into action by electrolysis.

The object of the present invention is, therefore, to provide electrodes for electrolysis processes or applications in which electrochemical conversions are desired or unavoidable and which are stable under the conditions which occur.

Although after electrolysis tests with commercially available carbon black-filled thermoplastics and according to the literature no information existed as to how the observed decomposition processes could be overcome, it has now surprisingly been found that specific combinations of synthetic macromolecular materials A and conductive additives B give electrodes, which are stable under electrochemical conditions. The present invention therefore relates to an electrode based on conductive materials and macromolecular materials as the binder, which is stable under electrolysis conditions and is particularly suitable for drying masonry, which is characterized in that it comprises A. a thermoplastic polar polymer, polycondensate or polyadduct or mixtures thereof, which can be well wetted by the electrolysis medium and are stable with respect to the electrochemical process taking place on the electrode and B. a mixture in a weight ratio of 1:4 to 4:1 of (a) conductive carbon black with a BET surface of more than 600 $m^2/g$ and/or carbon fibers and/or an intrinsically conductive polymer and (b) carbon black with a BET surface of less than 600 $m^2/g$ and/or graphite and/or transition metal oxides and/or an intrinsically conductive polymer.

The synthetic macromolecular material A is polar and stable relative to the electrolysis medium, i.e. it is hydroylsis-stable and particularly oxidation-stable in aqueous media. The material can be thermoplastically processed and can be, but does not have to be cross-linkable. Suitable as the macromolecular electrode component A have proved to be polar materials, including EVA (ethylene vinyl acetate), CPE (chlorinated polyethylene), TPU (thermoplastic polyurethane) but in particular polyether polyurethane, plasticized and rigid PVC (polyvinyl chloride), NBR (nitrile rubber), ABS (acrylonitrile - butadiene - styrene terpolymer), SBR (styrene butadiene rubber), fluorelastomers or mixtures of such materials. They must be well wetted by the electrolysis medium, but must not be swellable or dissolvable or (e.g. hydrolytically) decomposable.

Conductive additives B are nonmetallic and are on the one hand able to modify the material in a conductive manner, while on the other hand they can build up a potential during application (e.g. measured against a reference electrode before or after a certain operating time), without thereby impairing to a significant extent the serviceability of the system. Examples of conductive additives B are mixtures of a) so-called conductive carbon black (electrically conductive carbon black with a surface of more than 600 $m^2/g$) and/or carbon fibres and/or intrinsically conductive polymers with b) carbon black with a lower conductivity and a surface of less than 600$m^2/g$, graphite, intrinsically conductive polymers (in complexed or compensated form) or transition metal oxides. The intrinsically conductive polymers are e.g. polyacetylene, polypyrrole, polyphenylenes, polyanilines, polythiophenes, polyphthalocyanines and other polymers with conjugated $\pi$ electron systems. These conductive polymers can also in themselves form component B. The transition metal oxides may be e.g. Fe(II)/Fe(III) mixed oxides, $MnO_2$, $V_2O_3$, $Nb_2O_3$ and others, i.e. such oxides in which the transition metal can be elevated to a higher but also stable oxidation state.

Conductive additives B are mixed in concentrations of 3 to 75 and preferably 8 to 55% by weight with 25 to 97 and preferably 45 to 92% by weight of component A. If B is a mixture of conductive and potential-stabilizing materials, they are used in a weight ratio of 1:4 to 4:1.

An inventive electrode is considered to be stable if (a) at constant d.c. voltage a substantially constant current flows (whose magnitude is naturally dependent on the conductivity of the electrode and that of the system), while during the necessary operating period (e.g. from a few months to years) the decrease in the capacity does not drop below a value critical for the particular process;

(b) the electrode (usually the anode) remains mechanically stable (optical, simple embrittlement test, tensile strength test, no significant weight loss).

The resistivity preferred for the use as electrodes is below $10^4$ Ωcm, preferably below $10^3$ Ωcm and in particularly preferred manner below $2 \cdot 10_2$ Ωcm.

The electrode material is produced on commercially available plastic processing machines, such as twin screw extruders, internal mixers and the like using conventional processing agents, such as stabilizers, lubricants, fillers, etc. The material obtained is granulated or directly converted into the subsequent electrode form or shape (foils, plates, profiles, etc.). The electrodes are used in many different types of processes, e.g. as sensors, as electrodes for electrolytic oxidation or reduction, for electrocatalysis, for drying purposes, e.g. for masonry, slurries, peat and the like, as well as for desalting or corrosion protection purposes.

Testing of the electrodes takes place with a 6V d.c. voltage in an aqueous NaCl solution. The current flow rapidly drops in the case of graphite electrodes, which also applies with carbon fiber electrodes. Metal electrodes become spent. Carbon blackfilled polymer electrodes of e.g. cross-linked polyethylene containing a metal core clearly always have contacting problems and finally decompose the metal core through a weak point, while wetting by the electrolysis medium is poor.

Surprisingly, the inventive electrodes have a completely different behavior. Following an initially constant current, the current flow rises by up to 50%, then drops gradually and stabilizes at least the initial level, but frequently between the initial level and the maximum level.

No explanation can be given for the aforementioned phenomena. In particular, the mechanism of the potential-stabilizing and currentstabilizing function is unclear. To illustrate this values for initial and end current, initial and end resistance and end potential obtained from numerous tests, which are in part documented in the examples are shown in Table 1.

TABLE 1

| | Initial Current (mA) | End Current (mA) | Initial Resistance (Ω cm) | End Resistance (Anode) (Ω cm) | End Potential (V) |
|---|---|---|---|---|---|
| Carbon fiber electrode | 17.6 | 0.4 | 9 | $10^4$ | 1.8 |
| Inventive electrode carbon black-filled polyethylene* | 4.4 | 5.4 | 38 | $4 \cdot 10^4$ | 1.95 |
| electrode with metal core | 8.1 | 1.4 | 66 | $10^9$ | 2.0 |

Electrolyte: 2g NaCl in 100 ml $H_2O$
Duration of test: 14 days at 6 V and room temperature
Electrode surface approximately 25 $cm^2$.
*Commercial product of Raychem Corp.

The initial current is essentially determined by the resistance of the electrodes and is therefore higher in the case of carbon fibers. For a comparable end resistance (possibly in the case of the inventive electrode only the outermost surface is changed, which due to contacting problems simulates a higher resistance, whereas the internal resistance remains at the original level) and end potential, the inventive electrode has a more than 10 times higher current and this is even higher than the initial value. The electrode filled with conductive carbon black can also not stabilize the current.

In practice, the electrodes are brought into flat form, e.g. in the form of foils or plates. Foils, which have been stamped or punched out have proved satisfactory for the drying of walls (to facilitate plastering). The foils are contacted by conductors having a large cross-section, e.g. by welding. These conductors can run within the brickwork, while the contact point can also be located in the brickwork (e.g. plaster). The contact between the current source and the conductor must take place outside the brickwork with protection against moisture access. The electrodes may be applied to the masonry to be dried and/or desalted with a plaster which is particularly rich in calcium hydroxide and/or calcium carbonate.

For the operation of the electrodes, it is possible to use d.c. and a.c. voltages of the necessary level. For drying walls, preference is given to a voltage of between 4 and 48V, pulsed d.c. voltage being used for limiting the current flow at voltages above 6V.

The following non-limitative examples serve to further illustrate the invention, the quantities relating to weight.

EXAMPLE 1

80 parts of ethylene - vinyl acetate (20% VA) with 9 parts of conductive carbon black having a surface of 950 $m^2/g$ (Ketjenblack EC) and 11 parts of furnace black having a surface of 20 $m^2/g$ (Flammruss 101 of Degussa AG) and 3 parts of stabilizers and lubricants are mixed, plasticized and granulated in a closed mixer (formulation)

(1). The identical procedure is adopted with TPU (polyether type) (formulation 2) and plasticized PVC (formulation 3). Formulation 1 is also provided with the same composition, but using graphite instead of furnace black (formulation 4) and without furnace black for comparison purpose (formulation 5). The granulates are compressed into 2 mm thick plates and cut to electrodes of length 12.5 mm and width 20 mm.

A further anode comprised PVC and 40% polyaniline hydrochloride (formulation 6), whilst the cathode comprised PVC, 40% polyaniline and 8% conductive black. A carbon fiber strip was used as a further comparison electrode (formulation 7). The electrodes were placed in an electrolytic vessel in spatially separated, but electrolytically connected cylinders, the aqueous solution (2g NaCl/100 g $H_2O$ only half covering the electrodes, so that contact of the electrodes with the welded-in metal wires can take place outside the electrolysis medium. The cylinders have a valve fitted at the top, so that gases which form can be periodically let off during electrolysis.

When working with 6V d.c. voltage the results given in the following table were obtained. The comparison electrodes 5 and 7 are clearly inferior.

TABLE 2

| No. | Initial Conductivity (S/cm) | Current (after × hours) in mA 0 | 8 | 72 | 240 | 336 | Potential after 336 h (V) | Observations |
|---|---|---|---|---|---|---|---|---|
| 1 | 0.05 | 4.2 | 4.2 | 4.3 | 4.4 | 4.8 | 1.95 | Cathode: constant $H_2$ evolution<br>Anode: optically unchanged after test |
| 2 | 0.1 | 11.5 | 12.8 | 6.0 | 6.1 | 8.1 | 2.5 | C: constant, uniformly distributed $H_2$ evolution.<br>A: slight roughening. |
| 3 | 0.05 | 4.4 | 4.5 | 6.6 | 5.3 | 5.4 | 1.9 | C: as 2<br>A: as 1 |
| 4 | 0.05 | 4.0 | 4.3 | 3.6 | 3.6 | 3.7 | 2.0 | C: as 1, subsequently dropping<br>A: slight roughening. |
| 5 | 0.03 | 2.4 | 2.5 | 1.6 | 1.0 | 0.9 | 1.5 | C: significantly decreasing $H_2$ evolution<br>A: as 1 |
| 6 | 2 | 22 | 26 | 21 | 19 | 17 | —* | |
| 7 | 0.2 | 17.6 | 18.7 | 3.0 | 0.9 | 0.4 | 1.8 | C: initially brisk $H_2$ evolution and then dropping almost to zero<br>A: serious decomposition |

*not measured

EXAMPLE 2

In a comparison test two commercially available electrode materials (1: carbon black-filled PE, 2: carbon fiber strip) and an inventive electrode material (formulation of example 1, No. 3 but comprising as component Bb instead of furnace black a Fe(II)/Fe(III) mixed oxide (iron oxide pigment 130 M of Bayer AG) were connected as anodes in aqueous electrolysis (6V - 2% NaCl solution). Comparison materials 1 and 2 were electrically destroyed after 100 or 60 h and mechanically (tensile strength) after in each case approximately 60 h (FIGS. 1 and 2). However, the electrode material according to the invention still functional after 80 h with a significant capacity and was still not mechanically destroyed (FIGS. 3 and 4).

The weight change was:

(1) anode −11%/cathode −8% (destruction by oxidation or reduction,
material removal)

(2) anode +9%/cathode +14% (destruction by ion incorporation)

(3) anode +1%/cathode +4% (much lower weight changes in the case
of an 8-fold electrolysis time and capacity).

EXAMPLE 3

In a long-term test, three inventively composed electrode materials were used as the anode and cathode in aqueous electrolysis according to example 2. All electrodes were comprised of conductive carbon black (Ketjenblack EC) as component Ba in plasticized PVC. No. 1 and No. 2 contained as component Bb graphite and No. 3 the mixed oxide of example 2. The current curve is shown in FIG. 5 (not standardized for the electrode surface).

We claim:

1. An electrode based on conductive materials and macromolecular materials as a binder, the electrode being stable under electrolysis conditions and particularly suitable for drying masonry, comprising A. a thermoplastic polar polymer, thermoplastic polycondensate or thermoplastic polyadduct or a mixture thereof, which is wettable by an electrolysis medium and is stable with respect to an electrochemical process taking place on the electrode; and B. A mixture in a weight ratio of 1:4 to 4:1 of (a) conductive carbon black with a BET-surface of more than 600 $m^2/g$; and (b) a material selected from the group consisting of carbon black with a BET-surface of less than 600 $m^2/g$, transition metal oxides, an intrinsically conductive polymer and mixtures thereof.

2. The electrode according to claim 1, wherein component A is selected from the group consisting of polyvinyl chloride, chlorinated polyethylene and mixtures thereof.

3. The electrode according to claim 1, wherein components A and B are present in a weight ratio between 97:3 and 25:75.

4. Method of use of at least two electrodes according to claim 1 in a process of desalting and drying masonry, comprising contacting the electrodes with the masonry to be desalted and dried and applying a voltage across the electrodes.

5. The method of use according to claim 4 wherein a voltage of 4 to 48 V is applied.

6. The method of use according to claim 4, wherein the electrodes have a resistivity of less than $10^4$ Ω cm.

7. The method of use according to claim 4, wherein the electrodes are in the form of a foil or a plate having a large surface area, in contact with the masonry, the foil or plate being punched out to facilitate application to the masonry.

8. The method of use according to claim 4, wherein the voltage is applied to the electrodes by a current source positioned outside the masonry via conductors having a large cross-section and being made from the same material as the electrodes.

9. The method of use according to claim 4, wherein the voltage applied is a pulsed d.c. voltage.

10. The method of use according to claim 4, wherein the electrodes are applied to the masonry to be dried using a plaster which is rich in at least one of calcium hydroxide and calcium carbonate.

11. The method of use according to claim 4, wherein, in the process of drying, the masonry is also desalted.

12. The electrode according to claim 1, wherein component A is selected from the group consisting of ethylenevinyl acetate copolymer, polyurethane and polyvinyl chloride; component Ba is conductive carbon black having a BET surface of about 950 $m^2/g$; and component Bb is selected from the group consisting of furnace carbon having a BET surface of about 20 $m^2/g$, graphite, and mixed oxides of Fe(II) and Fe(III).

13. The electrode according to claim 12 containing about 80 parts of component A, 9 parts of component Ba and 11 parts of component Bb.

* * * * *